US006007438A

United States Patent [19]

Harrell

[11] Patent Number: 6,007,438

[45] **Date of Patent: *Dec. 28, 1999**

[54] ROUND ROTATING TABLE TENNIS

[76] Inventor: James Robert Harrell, 2642 Daniels Glen, Escondido, Calif. 92027

[ * ] Notice: This patent issued on a continued prosecution application filed under 37 CFR 1.53(d), and is subject to the twenty year patent term provisions of 35 U.S.C. 154(a)(2).

[21] Appl. No.: 09/002,540

[22] Filed: Jan. 2, 1998

[51] Int. Cl.[6] ..... A63B 67/04

[52] U.S. Cl. ..... 473/496

[58] Field of Search ..... 473/496, 491, 473/494, 475

[56] References Cited

U.S. PATENT DOCUMENTS

| | | | |
|---|---|---|---|
| 3,452,985 | 7/1969 | D'Zmura . | |
| 3,526,404 | 9/1970 | Wiggins . | |
| 4,108,434 | 8/1978 | Royer | 473/475 |
| 4,335,877 | 6/1982 | Long . | |
| 4,522,395 | 6/1985 | Arndt | 473/475 |

FOREIGN PATENT DOCUMENTS

| | | | |
|---|---|---|---|
| 2582225 | 11/1986 | France | 473/FOR 113 |
| 1750710 | 7/1992 | U.S.S.R. | 473/FOR 113 |
| 175711 | 7/1992 | U.S.S.R. | 473/FOR 113 |

*Primary Examiner*—Raleigh W. Chiu
*Attorney, Agent, or Firm*—Calif Terro

[57] ABSTRACT

A method of playing table tennis includes using a table comprising a rotating circular playing surface marked out in quadrants with adjacent quadrants being distinguishable from one another, a non-rotating net dividing the playing surface into two playing sides, a plurality of paddles, and a resilient ball; providing two teams of at least one player each; associating one team with a playing side and with a pair of opposed quadrants; and associating the other said team with the other playing side and the other opposed quadrants; determining a first serving team; the first serving team serving by propelling ball with a paddle against the playing side associated with the serving team and over the net directly into a quadrant associated with the serving team; wherein failure to do so scores a point for the other team; wherein each team alternately attempts to propel the ball with the paddles directly over said net into a quadrant associated with the team until one team fails to do so thereby scoring a point for the other team. Preferably, the rotation direction of the playing surface is variable and rotates at five to fifteen revolutions per minute.

18 Claims, 3 Drawing Sheets

ROUND ROTATING TABLE TENNIS

BACKGROUND—FIELD OF INVENTION

This invention relates to table tennis games that use a round table or playing surface.

BACKGROUND—DESCRIPTION OF PRIOR ART

Conventional table tennis, or Ping Pong, is recognized throughout the world, and is enjoyed by millions of people, of all ages. It can be purchased in most sporting goods stores, anywhere in the nation. In the prior art there are numerous variations of table tennis, and apparatus. Yet it is rare to see any of these variations for sale, in any store. To enter the market for table tennis games and apparatus, a new game would need to be as fun and challenging as ping pong, with some intriguing novel features, that would make people want to play it. There have been many attempts among prior art to invent such a game. For example: a table tennis game that can be played in a swimming pool, or one that folds up like a suitcase. Some inventions introduced the use of a circular table or playing surface. U.S. Pat. No. 4,335,877 to Long (1982) discloses a circular table having dividers that radiate from center of table. With the option of a centrally located post, used for screening and deflecting shots. To score a point, players must hit the ball into a section other than the one it just bounced in. This game offers a very limted amount of challenge. U.S. Pat. No. 3,452,985 to D'Zamura (1969) utilizes a circular table, with barriers that extend radially from the center of said table. These barriers converge at the center of the playing surface, referrred to as the "null circle," where play is restricted to an area outside of said circle. Because the playing area is limited, so is the amount of challenge or need for strategy. U.S. Pat. No. 3,526,404 to Wiggins (1970) features a rotatable rim, located on the outside edge of a circular table. Although designed primarily for playing marbles, this game can be adapted for table tennis. This however, requires the removal of said rim, and installation of a net, etc. Setting up this game would be more challenging than actually playing it.

It is evident that the aforementioned prior art has failed to have any impact, within the market of table tennis games and apparatus.

OBJECTS AND ADVANTAGES

Accordingly, several objects and advantages of the subject invention are:

(a) to introduce a table tennis game that adds novel elements of strategy and challenge to those those already found in conventional table tennis.

(b) to introduce a table tennis game having a round playing surface, that rotates.

(c) to introduce a table tennis game wherein the level of difficulty is adjustable.

(d) to provide a table tennis game that allows easier viewing than the high-speed back and forth motion spectators experience viewing conventional table tennis.

(e) to provide a table tennis game that gives players the potential for improving their skills and developing strategies.

Still further objects and advantages will become apparent from a consideration of the ensuing description and accompanying drawings.

REFERENCE NUMERALS

Figure 1:
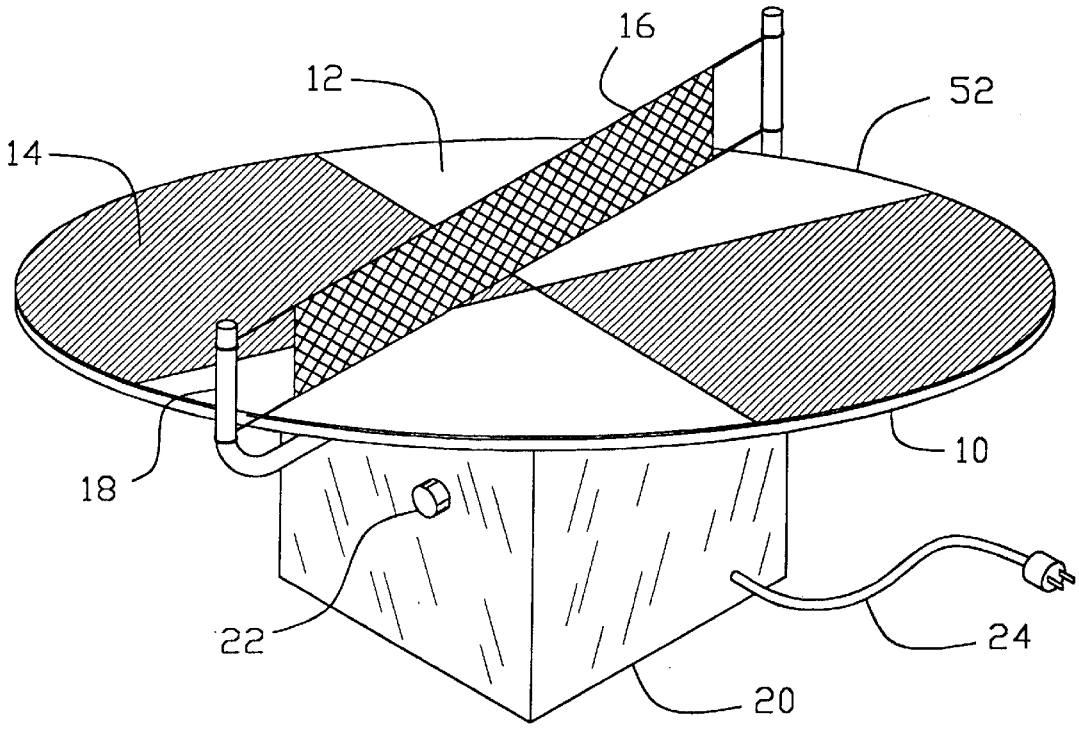
FIG. 1 is a perspective view of Round Rotating Table Tennis.

10 circular table
12 white quadrants
14 green quadrants
16 net
18 net support posts
20 pedestal
22 knob
24 power cord
26 disc
28 dowels
30 hub
32 screws
34 variable-speed motor
36 bracket
38 bolls
40 coin slot
42 molded plastic pedestal
44 nets' highest setting
46 threaded hand-grip fasteners

SUMMARY

Round Rotating Table Tennis is a game that is played similar to ping pong, using standard balls and paddles. It consists of a round rotatable table mounted to a pedestal. The tables' playing surface is marked out into quadrants by two alternating colors. A net bisects said table into two equal playing sides, and is attached to said pedestal.

PREFERRED EMBODIMENT—DESCRIPTION

FIG. 1 is a perspective view of Round Rotating Table Tennis.

FIG. 1 shows Round Rotating Table Tennis, comprising a circular table 10, of particle board composition, approximately two and one half meters in diameter. A playing surface is marked out into quadrants, by two alternating colors. White quadrants 12 and green quadrants 14. A net 16 bisects said table equally, defining the two playing sides. Net 16 is mounted to a pedestal 20, using net support posts 18. Pedestal 20 has a knob 22, attached to its exterior, which controls table 10 rotation speed. Power cord 24 protrudes from lower exterior of pedestal 20.

Figure 2:
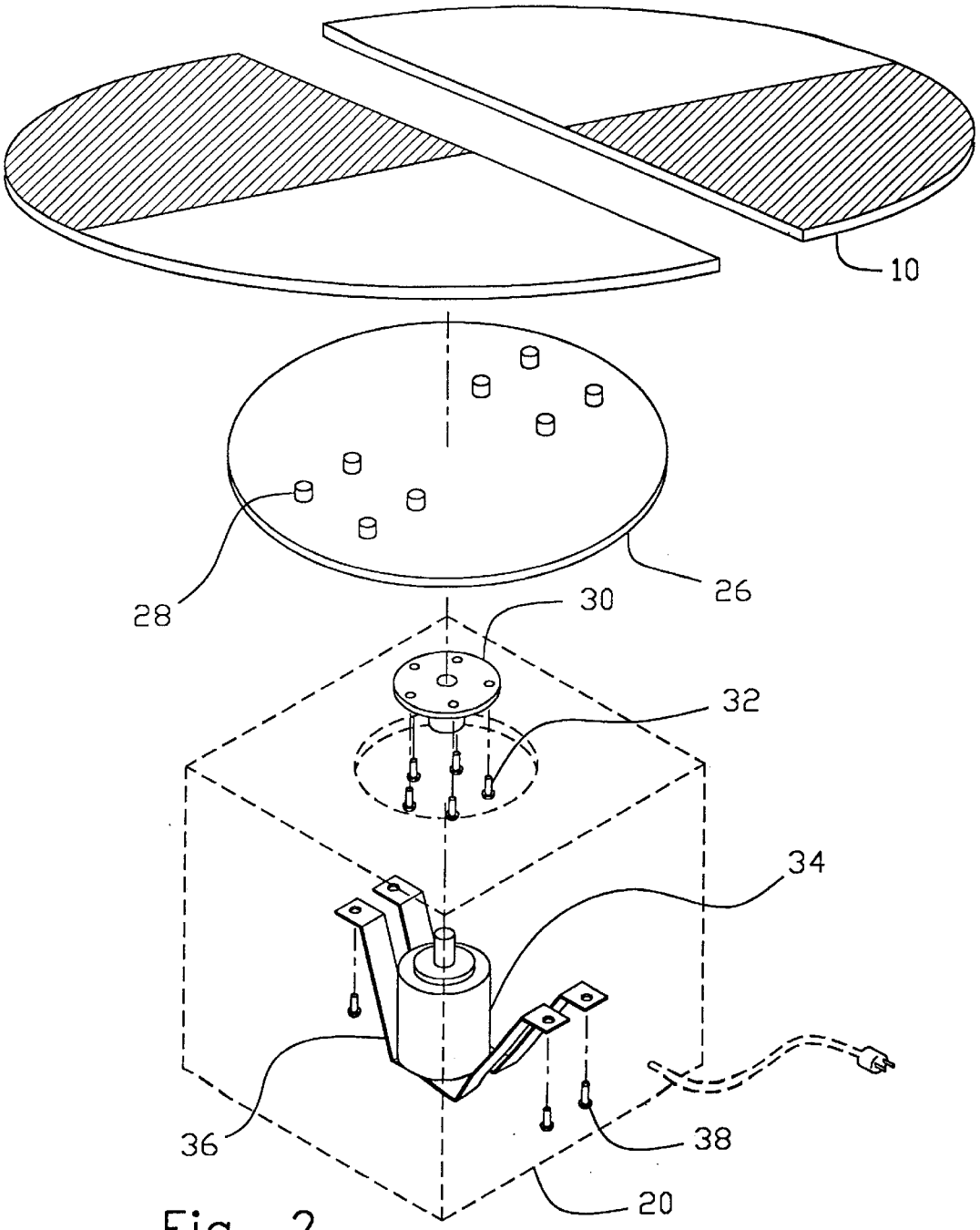
FIG. 2 is an exploded view of embodiment in FIG. 1

FIG. 2 is an exploded view of embodiment in FIG. 1. Circular table 10 is comprised of two halves, removably mounted to a disc 26 using dowels 28, and threaded hand-grip fasteners 46. Disc 26 is fastened to a hub 30 using screws 32. Hub 30 is attached to a variable-speed motor 34, which mounts inside pedestal 20, using a bracket 36, and bolts 38. Net support posts 18 are shown at the nets' highest setting 44.

PREFERRED EMBODIMENT—OPERATION

Round Rotating Table Tennis can be played the same as ping pong, using the same balls, paddles, and scoring system. Prior to starting a game, the two players will pick in which color quadrant they'll be hitting into. Either green or white.The green player can only hit into a green quadrant on white players' side of the table. The white player can only hit into a white quadrant on green players' side. When serving, the ball must bounce once on servers' side, anywhere, then go over the net and land in the appropriate quadrant. A ball served or returned into the wrong color quadrant is a point for the opponent. Because the table is rotating, the quadrants are always in motion. This novel challenge requires timing, judgement, and quick thinking by both players, throughout the game. This challenge increases in difficulty, relative to table rotation speed. Also relative to the speed at which the table rotates, is the amount of ball deflection that occurs when hit onto a spinning surface. This novel feature, makes it seem as though the ball had a mind of is own. With some practice however, this ball deflection is predictable. Which has given birth to several novel strategies. The level of difficulty can be adjusted to accomodate players from beginner to expert. For the expert players, a table rotation speed of approximately ten to fifteen revolutions per minute, with the net placed at its lowest setting, is recomended. For the beginner players a slower rotation speed of approximately five to ten revolutions per minute, with net placed at its highest setting is recomended. The reason changing the height of the net affects the level of difficulty is because with the net at a higher setting, the ball must be hit with an upwards trajectory in order to clear the net. This slows the velocity of the ball making it easier to return. On the other hand, a low net setting allows the ball to be hit with a downward trajectory. Which results in a faster ball that is hard to return.

OTHER EMBODIMENTS

Alternate Embodiment—Description

Figure 3:
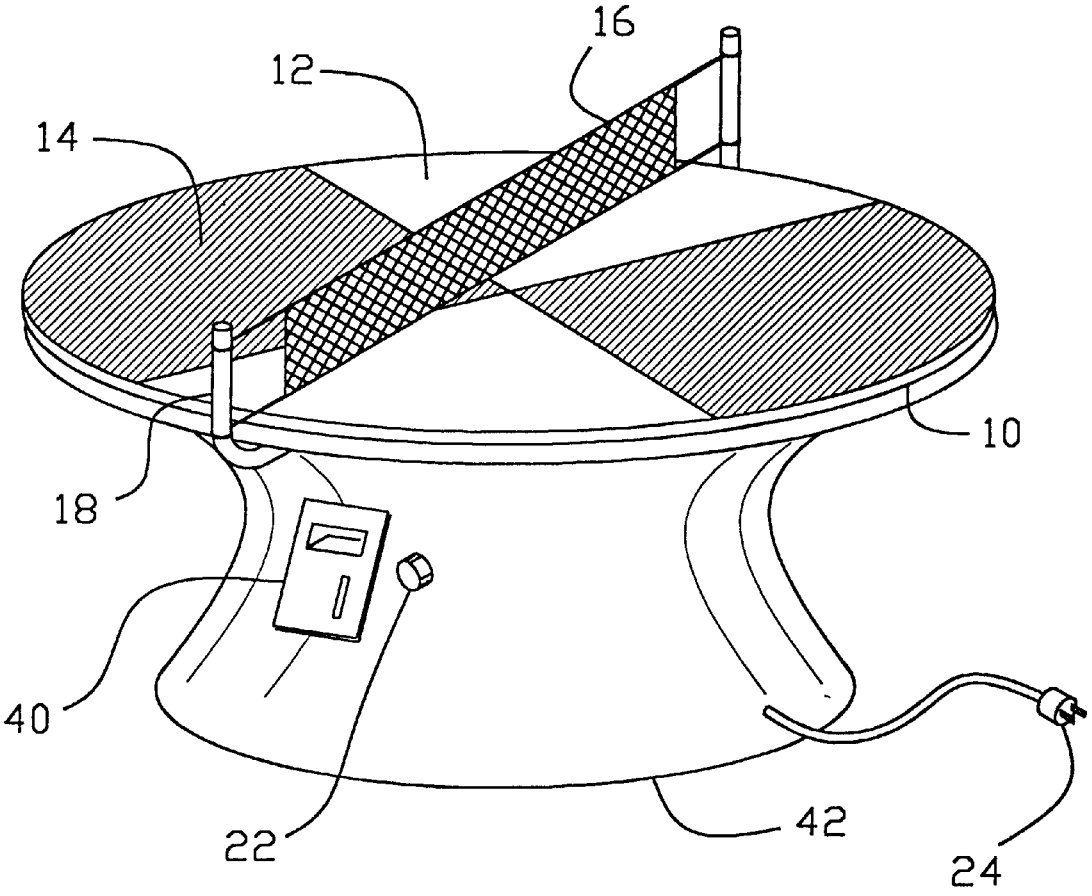
FIG. 3 is a perspective view of an alternate embodiment.

As shown in FIG. 3 an alternate embodiment is illustrated having a molded plastic pedestal 42, and a coin slot 40, showing a potential for commercial use. Said embodiment may have computerized control capabilities. Which enables table rotation to change speed and or direction at any time during play.

Alternate Embodiment—Operation

This embodiment has the capability of "Random Rotation". A game where the speed and or direction of table rotation changes at random. This requires players' increased awareness. Otherwise games are played the sameway as in Preferred Embodiment.

CONCLUSIONS, RAMIFICATIONS, AND SCOPE

Accordingly, it can be seen that I have invented an improved table tennis game that introduces novel elements of strategy and challenge. Round Rotating Table Tennis utilizes a table member, which is flat, of circular shape, having its upper surface, or playing surface, marked out into quadrants, by two alternating colors. A net bisects said playing surface equally, defining the two playing sides. Said net is supported by posts, which attach to a pedestal. Said pedestal supports the table and houses mechanical means for table rotation.

Although the description above contains many specificities, these should not be construed as limiting the scope of the invention but as merely providing illustrations of some of the presently preferred embodiments of this invention. Various other embodiments and ramifications are possible within it's scope. For example, Round Rotating Table Tennis could be used as:

(a) A rotating buffet table.

(b) A model carousel or Merry-Go-Round.

(c) A rotating display table.

Thus the scope of the invention should be determined by the appended claims and their legal equivalents, rather than by the examples given.

What is claimed is:

1. A method of playing table tennis including:

using a table comprising a rotating circular playing surface marked out in quadrants with adjacent quadrants being distinguishable from one another, a non-rotating net dividing said playing surface into two playing sides, a plurality of paddles, and a resilient ball;

providing two teams of at least one player each;

associating one said team with a said playing side and with a pair of opposed quadrants; and associating the other said team with the other said playing side and the other said opposed quadrants; wherein each said team alternately attempts to propel said ball with said paddles directly over said net into a quadrant associated with said team until one said team fails to do so thereby scoring a point for the other team.

2. The method of claim 1 wherein the direction of rotation of said playing surface is variable.

3. The method of claim 1 wherein said opposed quadrants are of the same color.

4. The method of claim 1 wherein said net divides said table into equal areas.

5. The method of claim 1 wherein said playing surface is approximately two and one half meters in diameter.

6. The method of claim 1 wherein said playing surface rotates at five to fifteen revolutions per minute.

7. The method of claim 1 wherein said playing surface rotates at ten revolutions per minute.

8. The method of claim 1 wherein said net is adjustable in height.

9. The method of claim 1 wherein the speed of rotation of said playing surface is variable.

10. A method of playing table tennis including:

using a table comprising a rotating circular playing surface marked out in quadrants with adjacent quadrants being distinguishable from one another, a non-rotating net dividing said playing surface into two playing sides, a plurality of paddles, and a resilient ball;

providing two teams of at least one player each;

associating one said team with a said playing side and with a pair of opposed quadrants; and associating the other said team with the other said playing side and the other said opposed quadrants;

determining a first serving team; said first serving team serving by propelling said ball with a said paddle against the playing side associated with said serving team and over the net directly into a quadrant associated with said serving team; wherein failure to do so scores a point for the other team; wherein each said team alternately attempts to propel said ball with said paddles directly over said net into a quadrant associated with said team until one said team fails to do so thereby scoring a point for the other team.

11. The method of claim 10 wherein the direction of rotation of said playing surface is variable.

12. The method of claim 10 wherein said opposed quadrants are of the same color.

13. The method of claim 10 wherein said net divides said table into equal areas.

14. The method of claim 10 wherein said playing surface is approximately two and one half meters in diameter.

15. The method of claim 10 wherein said playing surface rotates at five to fifteen revolutions per minute.

16. The method of claim 10 wherein said playing surface rotates at fifteen revolutions per minute.

17. The method of claim 10 wherein the speed of rotation of said playing surface is adjustable.

18. The method of claim 10 wherein said net is adjustable in height.

* * * * *